United States Patent [19]

Welton et al.

[11] Patent Number: 4,513,561

[45] **Date of Patent: * Apr. 30, 1985**

[54] FLEXIBLE SPUR HOLDERS AND SPURS

[76] Inventors: Charles L. Welton, Rte. 2, Box 505 V, Golden, Colo. 80401; Pershing R. Van Scoyk, 7193 W. 32nd Ave., Wheatridge, Colo. 80033

[ * ] Notice: The portion of the term of this patent subsequent to Apr. 24, 2001 has been disclaimed.

[21] Appl. No.: 428,351

[22] Filed: Sep. 29, 1982

Related U.S. Application Data

[63] Continuation-in-part of Ser. No. 289,808, Aug. 3, 1981, Pat. No. 4,443,996.

[51] Int. Cl.[3] ..... A43C 17/00

[52] U.S. Cl. ..... 54/83 R

[58] Field of Search ..... 54/83 R, 83 A; 36/71.5, 36/74; D30/31

[56] References Cited

U.S. PATENT DOCUMENTS

| | | | |
|---|---|---|---|
| 308,413 | 11/1884 | Kaino | 54/83 R |
| 2,098,017 | 11/1937 | Seyfarth | 54/83 R |
| 2,454,228 | 11/1948 | Smith | 54/83 A |
| 2,487,461 | 11/1948 | McKinney | 54/83 R X |
| 3,953,958 | 5/1976 | Beaston | 54/83 A |

*Primary Examiner*—Robert P. Swiatek

*Attorney, Agent, or Firm*—Jerry W. Berkstresser

[57] ABSTRACT

A spur holder is formed of flexible material and has a rear body and sides connecting the body to a front loop, which is stretchable over the heel of the boot to engage the front of the heel, with the rear body disposed at the rear of the boot adjacent the upper edge of the heel. The rear body has a generally oval front edge and a rear edge corresponding generally to a portion of an ellipse, while each of the front and rear edges of the loop corresponds generally to a flattened oval. A rib extends inwardly from the rear body and a portion of each of the sides, adjacent the inner edge of each and is adapted to engage a crevice above the heel when the holder is installed on a boot. A spur rowel and shank are attached to the rear body, as by a plate molded within the rear body or a cap which covers the plate and is vulcanized to the rear body. The inner edge of each of the sides may be provided with a taper opposite the rib to accommodate additional stretching of these edges. A spur is produced by molding an outwardly extending, integral button on the rear body, while an alternative molded spur has a downwardly bowed front loop which includes a downward offset connecting it with each side and the front of the rear body is concave and slopes downwardly and forwardly. The rear body and a major part of each side have an inwardly extending, downwardly sloping rib for engagement with the crevice between the heel and the counterheel. The shank may be molded integrally with the rear body and have a vertical slot across which a pin extends to rotatably support a rowel.

9 Claims, 13 Drawing Figures

FLEXIBLE SPUR HOLDERS AND SPURS

This application is a continuation-in-part of our copending application Ser. No. 289,808 filed Aug. 3, 1981 for Flexible Spur Holder and Spurs now U.S. Pat. No. 4,443,996, granted Apr. 24, 1984.

This invention relates to flexible spur holders and spurs.

BACKGROUND OF THE INVENTION

There have been previous attempts to provide straps or other devices for holding spurs and prevent the rowel of the spur from falling down or riding up at the rear of the boot. Davis U.S. Pat. No. 71,462, Boos U.S. Pat. No. 1,882,059 and Smith U.S. Pat. No. 2,432,102 are examples of spur straps which include a lower strap passing under the sole of the boot and an upper strap passing over the instep of the boot. An improved tiedown strap for spurs is disclosed in the pending application of the present applicants, Ser. No. 255,232 filed Apr. 17, 1981, now U.S. Pat. No. 4,348,854. This tiedown strap is flexible, including a body having a hole which engages the spur shank and an opposite loop which extends around the heel at the underside of the sole of the boot. It is also provided with an ear extending upwardly to each side, to which an instep strap may be affixed. Such an instep strap may be a conventional buckle strap, or a flexible strap having a hole at each end which snaps over a button mounted at the front of the conventional side bar of the spur. This construction, however, requires a conventional mounting for the spur.

Among the objects of this invention are to provide a spur holder which is flexible and can be removably mounted on a boot without the necessity of additional straps, either tiedown straps or instep straps; to provide such a spur holder to which a spur shank and rowel may be attached, as by vulcanization or molding; to provide such a spur holder which can be relatively easily placed on or removed from the boot, without the necessity of unfastening any buckles, buttons or other connections; to provide such a spur holder which will hold the shank of the spur in a firm position at the rear of the boot and does not tend to come off the boot; to provide such a spur holder which is provided with an integral button which performs the functions of the rowel; to provide an alternative spur which is formed of resilient material and is resiliently held on the boot and requires no additional straps, buckles, or buttons or other connections; to provide such an alternative spur which may be molded; to provide such an alternative spur which may be provided with a shank and a rowel mounted thereon for rotation; to provide such a spur, the construction of which will hold the shank of the spur in a firm position at the rear of the boot and does not tend to come off the boot; and to provide such a spur holder and spur which are easily and economically manufactured.

SUMMARY OF THE INVENTION

A flexible spur holder of this invention includes a curved rear body and a front loop which are connected by arcuate sides, to form a hole which permits the loop to be stretched over the heel of a boot adjacent the sole. A cap, which may be vulcanized to the body, attaches a spur having a shank carrying a pivoted rowel at its outer end and an integral or attached plate at its inner end, with the cap overlying the plate. The opposite side of the body, from the cap, may be provided with a rib which extends around the hole and onto the sides. The rib is adapted to extend into the crevice between the heel and the counter-heel of the boot, to restrain upward or downward movement. The inner edge of each side may be tapered, to permit this portion to stretch when the holder is converted from a flat to a tubular shape when stretched around the heel to place the rowel at the rear. The spur holder is formed of a material, such as neophrene, having a very high resistance to fatigue stress. The spur shank and plate may be placed in the mold and the cap molded integrally with the reaminder of the holder. Also, an integral button may extend from the body of the holder, to form a unitary spur.

A molded alternative spur of this invention may be formed of similar resilient material and provided with a rear body having a front surface which is curved and sloped to correspond to the rear of the counterheel of the boot on which it is to be mounted. A front loop, spaced slightly downwardly from the front end of each side of the spur, may be downwardly bowed to accommodate variations in heel widths, while an inwardly extending and downwardly tapered rib, extending along the bottom of each side and also around the bottom of the front surface of the rear body, engages the crevice between the top of the heel and the bottom of the counterheel of the boot. A rearwardly extending shank may be provided with a vertical slot between a pair of rearwardly extending arms, between which the rowel may be rotatably mounted on a transverse pin. The tension of the front loop against the heel and between the sides, maintains the rib in engagement with the top of the heel and the bottom of the counterheel, while the laterally curved and downwardly sloping front surface of the rear body hugs the rear of the counterheel. The rib assists in preventing any impact on the rowel or shank from pushing the spur off the boot, in a downward direction, while the tension of the loop around the front of the heel holds the rib in place and assists in preventing any impact from pushing the rear end of the spur upwardly on the boot.

THE DRAWINGS

DESCRIPTION OF THE PREFERRED EMBODIMENT

Figure 1:
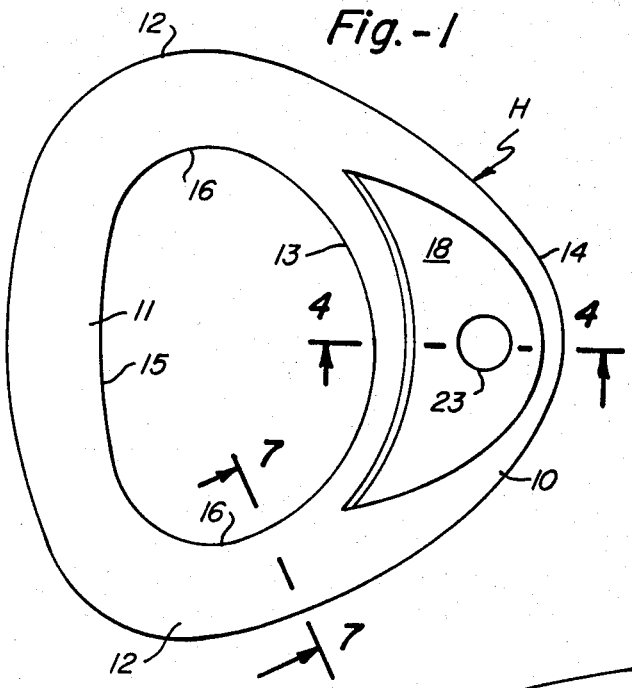
FIG. 1 is a top plan view of a flexible spur holder of this invention.
Figure 2:
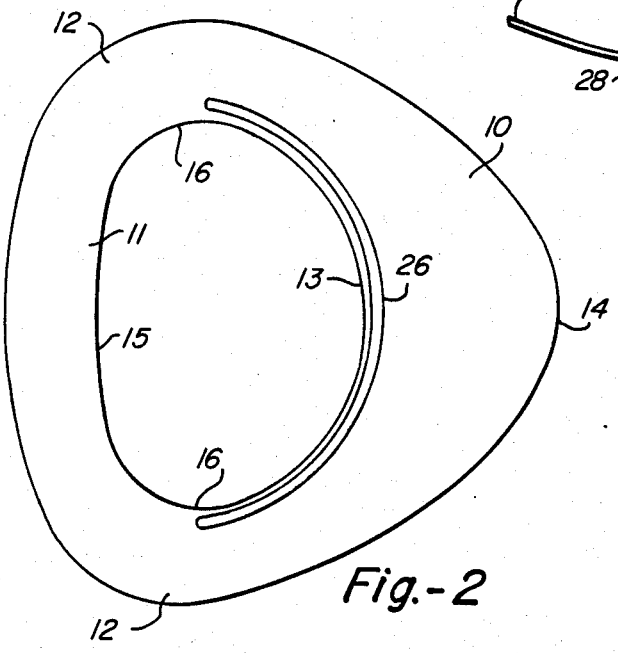
FIG. 2 is a bottom plan view of the holder of FIG. 1.

As illustrated in FIGS. 1 and 2 of the drawing, a flexible spur holder H of this invention may include a curved rear body 10 and a front loop 11 which are connected by arcuate sides 12, with the front and rear edges 13, 14 of the body 10 being essentially elliptical in shape and the rear edge 15 of loop 11 being a flattened oval. The front edge of the rear body 10 and the rear edge of loop 11, with the inner edges 16 of sides 12, form a hole which permits the loop to be stretched over the heel 17 of a boot B, as in FIG. 3. Atop the body 10 is a cap 18 which may be vulcanized to the body 10, as in FIG. 4, for attaching a spur having a shank 20 carrying a pivoted rowel 21 at its outer end and an integral or attached plate 22 at its inner end, with the cap overlying the plate. Cap 18 is provided with a hole 23 through which shank 20 extends, while hole 23 has an inner enlargement 24, as shown, to receive plate 22. The spur holder H is further provided with a rib 26 on the underside, as in FIGS. 2, 4 and 5, which is spaced from edge 13 of body 10 and a segment of edge 16 of each side 12, for a purpose hereinafter described.

The front edge of cap 18 may be spaced from front edge 13 of body 10, while the rear edge of the cap may be spaced further away from rear edge 14 of body 10 as it extends forwardly, as shown in FIG. 1. The spur holder H is formed of a tough but resilient material which can be stretched but will exert a reasonably strong pull. The material of the spur holder should also have a very high resistance to fatigue stress, since it may be stretched and pulled and permitted to retract hundreds or thousands of times during a useful life. A suitable material comprises molded neoprene, such as having the trade designation NIL-R 3065 SC 515, with a tensile strength of approximately 15,000 pounds per square inch.

Figure 3:
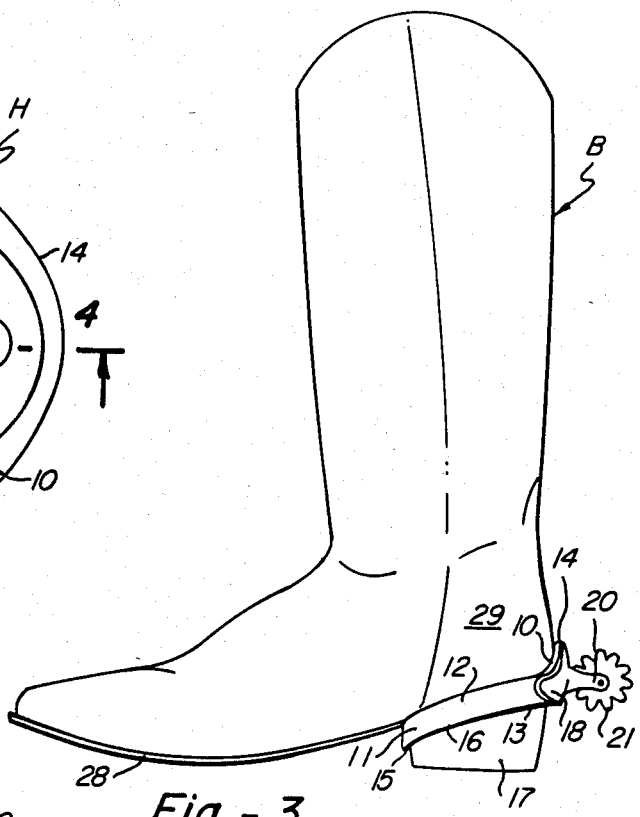
FIG. 3 is a side elevation, on a reduced scale, of a flexible holder and spur of this invention mounted on a boot.

The holder, as indicated, is adapted to fit around heel 17 of boot B, with the front loop 11 engaging the front of the heel and the front corners of the heel, beneath sole 28. The sides 12 extend along the sides of the heel and the body 10 fits against the remainder of the sides of the heel and the counterheel 29 of the boot. In installing the holder H, the underside of the body 10 is moved upwardly along the heel at the rear, with its rear edge 14 upwardly and its front edge 13 downwardly, so that the edge 15 of loop 11 will be down and the loop will be flat against the front of the heel. Thus, the holder H will encircle the heel without any twist in the loop or sides, while the sides 12 will be stretched between the front loop and the rear body in an essentially straight direction. In the position of FIG. 3, the rib 26 will engage the crevice between the heel 17 and the counterheel 29, since the rib 26 will extend inwardly into the crevice when the rear body 14 is twisted upwardly.

Figure 4:
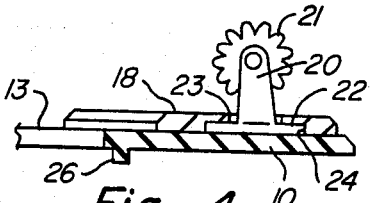
FIG. 4 is a cross section, on an enlarged scale, taken along line 4—4 of FIG. 1.
Figure 5:
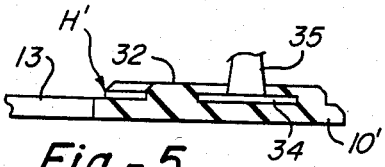
FIG. 5 is a cross section corresponding to FIG. 4 but showing an alternative attachment of the spur shank to the holder.
Figure 6:
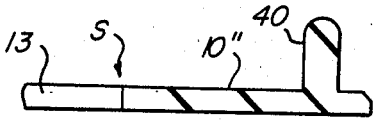
FIG. 6 is a cross section corresponding to FIG. 4 but showing an alternative construction having a molded button in lieu of the rowel.
Figure 8:
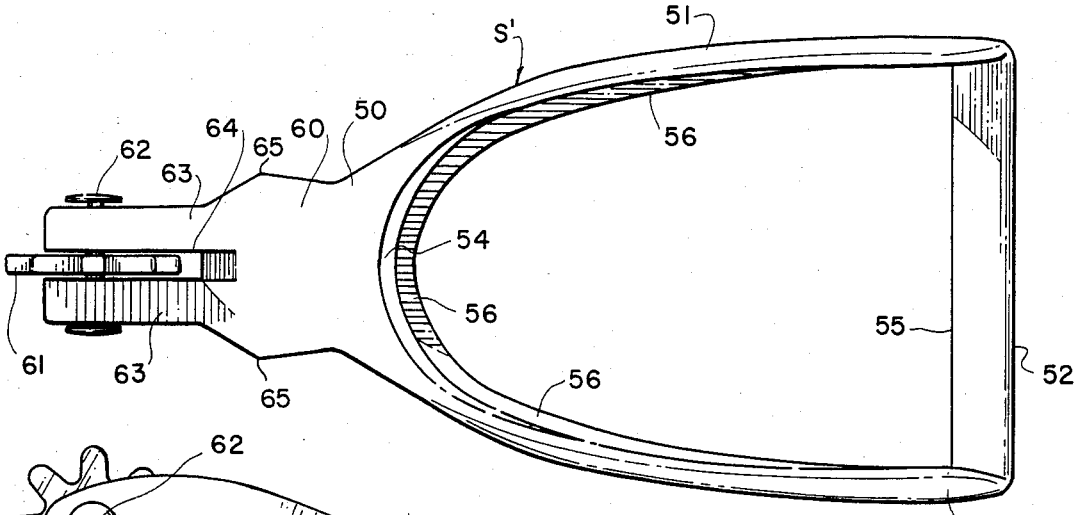
FIG. 8 is a top plan view of a molded, alternative spur of this invention.
Figure 9:
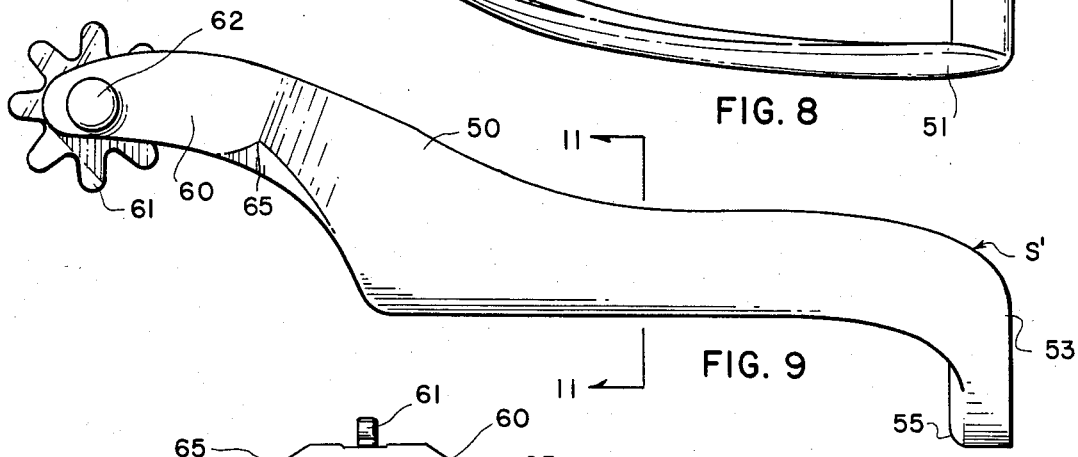
FIG. 9 is a side elevation of the spur of FIG. 8.
Figure 10:
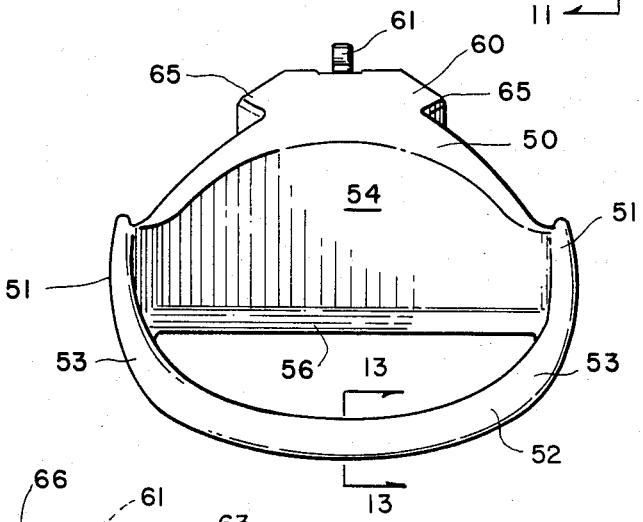
FIG. 10 is a front elevation of the spur of FIG. 8.
Figure 11:
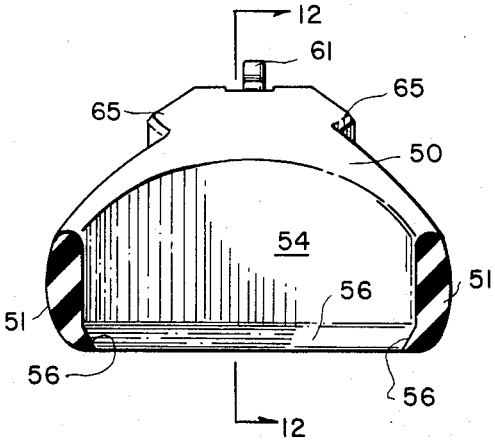
FIG. 11 is a central cross section, taken rearwardly from line 11—11 of FIG. 9.
Figure 12:
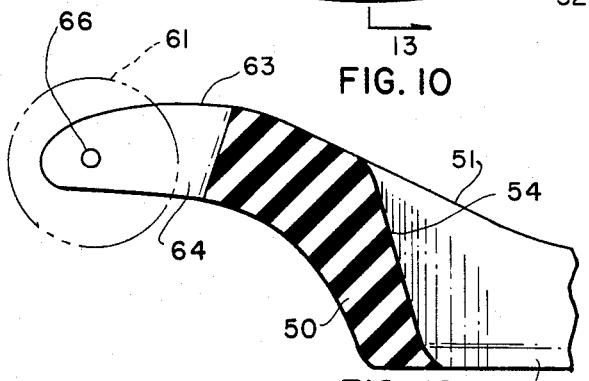
FIG. 12 is a fragmentary longitudinal section, taken along line 12—12 of FIG. 11.
Figure 13:
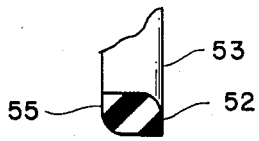
FIG. 13 is a fragmentary cross section, taken along line 13—13 of FIG. 10.

In an alternative holder H' illustrated in FIG. 5, the spur holder is provided with an alternative rear body 10' having an integral molded cap 32, which encloses a plate 34 integral with a stem 35 which forms a shank, to the outer end of which a rowel 21 of FIG. 4 may be attached. In the alternative construction of FIG. 6, an integrally molded button 40 extends from a further alternative rear body 10" of a spur S. The button 40 is used for the same purpose as the rowel 21, but the spur S is adapted to be used by those who prefer a less vigorous prodding of the horse. The remainder of the spur S may be similar to the remainder of the holder H of FIG. 1.

Figure 7:
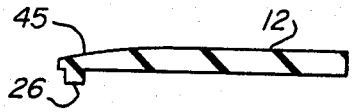
FIG. 7 is a cross section, on a further enlarged scale, taken at the position of line 7—7 of FIG. 1 but showing an alternative construction having a taper to permit stretching of particular edges.

In the alternative construction illustrated in FIG. 7, the inner edge of each side 12 is provided with a taper 45, which will be on the lower edge of side 12, on the outside of the heel 17 when the spur holder is installed, thereby permitting the side edges 16 to stretch more readily to accommodate the different position of the parts, i.e. the sleeve-like position, shown in FIG. 3, as compared with the flat position as molded, shown in FIG. 1.

As will be evident, in addition to the clamping action provided by the resiliency of the spur holder, rib 26 assists in maintaining the spur in position, without riding up or down. The spur holder of this invention is readily placed and removed from the boot and also could be left on the boot when the boot is removed, since there is no instep strap to resist pulling the boot off the foot.

The spur S of the invention illustrated in FIG. 5, as well as the spur S' of FIGS. 8–13, are similarly relatively simple to place on the boot and remove and also do not require any unlatching or unfastening of any type of connection. Spur S' is premolded of resilient material to conform to selected portions of the boot and includes a rear body 50 and integral sides 51, connected with a downwardly offset, front loop 52 by upturned ends 53 of loop 52. A front surface 54 of body 50 slants forwardly and downwardly, as in FIG. 12, and is laterally concave to approximate the shape of the rear portion of the counterheel of the boot, indicated at 29 in FIG. 3. The rear edge 55 of loop 52, as in FIG. 13, may be transversely convex to fit into the angle between the underside of the boot sole and the front edge of the heel, in a manner similar to loop 11 of FIG. 3. The lower edge of each side is provided with an inwardly extending rib 56, which tapers to an edge, as in FIG. 11, and extends along each side and also around the lower edge of the front surface 54 of the body 50. Rib 56 may be molded to fit into the groove or crevice between the heel and counterheel of the boot, such as heel 17 and counterheel 29 of FIG. 3.

A shank 60 extends rearwardly from the rear body 50 of the spur S', for supporting a rowel 61 on a pin 62, which extends transversely between a pair of arms 63, on opposite sides of a slot 64, in which the rowel 61 is adapted to rotate. Shank 60 may also be provided with a triangular wing 65 at each side, for reinforcement and decorative purposes. As in FIG. 12, a hole 66, in each arm 63, receives the pin 62, at the center of the desired position of rowel 61, the position of which is indicated by dotted lines in FIG. 12. Pin 62 may be a conventionally rivet type pin, having a formed head at each end, as shown. Or, pin 62 may be comprised of two parts, one an interiorly threaded sleeve having a head at one end and the other a screw having threads adapted to engage the threaded sleeve. The heads of the sleeve and screw may be conventionally slotted, if desired, while pin 62 may be constructed in any other suitable manner.

As will be evident, the resilience of the material of which the spur S' is made, except for rowel 61 and pin 62, each of which may be formed of a harder material, such as metal or plastic, permits the spur S' to be mounted on the boot by placing loop 52 against the front of the heel of the boot and shifting it upwardly until in engagement with the underside of the sole of the boot, then the rear of the spur, as by grasping the shank 50, may be moved upwardly until rib 56 snaps or slips into the crevice between the top of the heel and the bottom of the counterheel, whereupon the front surface 54 of the rear body will engage the counterheel and the spur will fit snugly on the boot. When the spur is so installed, the sides 51 will be stretched between the offset 53 of front loop 52 and the rear body 50 in an essentially straight direction. Rib 56, through its position in the aforesaid crevice between the heel and the counterheel, assists in preventing the spur from sliding downwardly on the heel. Thus, any downwardly directed impact against the rowel 61, as when the spur is moved upwardly to engage a flank of the horse or similar but accidental impact, would normally be resisted by rib 56, whose position is maintained by the tension of the spur stretched between the rear of the counterheel and the front of the heel. While the spur S' and particularly the loop 52, rib 56 and front surface 54 of the rear body 50, may be molded to fit precisely a particular pair of boots, an approximation of the contours engaged by these parts may be produced in a mold, so that the spur will fit with reasonable accuracy a number of boots which vary only slightly in contour and dimension. Thus, the front loop 52 is bowed slightly downwardly at the center, as in FIG. 10, so that it will accommodate somewhat different widths of heel but provide sufficient force to maintain the rib 56 in the appropriate crevice. The upturn 53 of the ends of the front loop accommodates the thickness of the sole, since the underside of each side 51, at rib 56, will be above the sole, while loop 51 will be below the sole of the boot. The material of which the molded spur is made may be the same or similar to the material of which the spur holder is made, such as neoprene having the trade designation NIL-R 3065 SC 515 or the equivalent.

Although different embodiments of this invention including an embodiment which provides a complete molded spur, are illustrated and described, it will be understood that other embodiments may exist. It will also be understood that other variations may be made without departing from the spirit and scope of this invention.

What is claimed is:

1. A spur holder, for a spur having a shank and rowel mounted on said shank and for holding said spur on a boot having a sole and a heel, comprising:

a rear body and sides connecting said body to a front loop, said holder being formed of flexible material, whereby said front loop may be stretched over said heel to engage the front of said heel with said rear body disposed at the rear of said boot adjacent the upper edge of said heel, said sides stretched between said front loop and said rear body in an essentially straight direction;

means for attaching said shank to said rear body; and said front loop, sides and rear body are molded with said rear body extending generally upwardly from said sides and said front loop disposed downwardly from said sides.

2. A spur holder as defined in claim 1, wherein:

said front loop is provided with a downward offset connected to each side.

3. A spur holder as defined in claim 1, wherein:

said rear body is provided with a front surface which is inclined rearwardly and upwardly.

4. A spur holder for a spur having a shank and a rowel mounted on said shank and for holding said spur on a boot having a sole and a heel, comprising:

a rear body and sides connecting said body to a front loop, said holder being formed of flexible material, whereby said front loop may be stretched over said heel to engage the front of said heel with said rear body engaging the rear of said boot at and immediately above the upper edge of said heel;

a rib extending inwardly from said rear body and at least an adjoining portion of said sides adjacent the inner edges thereof and positioned to engage a crevice above the heel of said boot when said holder is installed on said boot; and means for attaching said shank to said rear body.

5. A spur holder as defined in claim 4, wherein:

said shank is integral with said rear body.

6. A spur for mounting on a boot having a heel, comprising:

a rear body and sides connecting said body to a front loop;

means, for engaging an animal, extending rearwardly from said rear body;

said spur being formed of flexible material and said rear body, sides and front loop being constructed and arranged whereby said front loop may be stretched over said heel to engage the front of said heel with said rear body engaging the rear of said boot adjacent the upper edge of said heel and said sides stretched between said front loop and said rear body in generally straight lines.

7. A spur as defined in claim 6, including:

a rib extending inwardly from said rear body and at least an adjoining portion of said sides, adjacent the inner edges thereof, said rib being positioned to engage a crevice above the heel of said boot when said spur is installed.

8. A spur for mounting on a boot, comprising:

a rear body, sides and front loop moulded integrally;

said front loop having a downward offset connecting said loop with each of said sides;

said sides extending from said front loop rearwardly in spaced, slightly converging relation to said rear body;

said rear body having a concave front surface slanted downwardly and forwardly;

said rear body and a major portion of each of said sides having an inwardly extending, downwardly tapered, integral rib adapted to engage a crevice between the heel and a counter heel of said boot, with said front loop engaging the front of said heel and said sides being stretched between said front loop and said rear body; and means connected to said rear body for supporting a spur rowel.

9. A spur as defined in claim 8, wherein:

said means connected to said rear body comprises a rearwardly extending shank, integral with said rear body and having an upright, longitudinal slot therein; and pin means extending across said slot for rotatably supporting a rowel.

* * * * *